US006762680B2

(12) United States Patent
Blum

(10) Patent No.: US 6,762,680 B2
(45) Date of Patent: Jul. 13, 2004

(54) METHOD AND APPARATUS FOR ELECTRODYNAMIC INTRUSION DETECTION

(76) Inventor: Dieter W. Blum, 5115 - 244th Street, Langley, B.C. (CA), V2Z 1G5

( * ) Notice: Subject to any disclaimer, the term of this patent is extended or adjusted under 35 U.S.C. 154(b) by 0 days.

(21) Appl. No.: 09/728,164

(22) Filed: Dec. 1, 2000

(65) Prior Publication Data

US 2001/0028307 A1 Oct. 11, 2001

Related U.S. Application Data

(60) Provisional application No. 60/168,782, filed on Dec. 2, 1999.

(51) Int. Cl.[7] ..... G08B 13/18

(52) U.S. Cl. ..... 340/552; 340/541; 340/561; 340/567

(58) Field of Search ..... 340/540, 541, 340/545.3, 551, 552, 553, 554, 561, 565, 567; 342/432, 173, 28, 27, 110, 114, 115

(56) References Cited

U.S. PATENT DOCUMENTS

| | | | | | |
|---|---|---|---|---|---|
| 5,130,543 | A | * | 7/1992 | Bradbeer | 342/432 |
| 5,150,099 | A | * | 9/1992 | Lienau | 340/552 |
| 5,287,111 | A | * | 2/1994 | Shpater | 342/28 |
| 5,920,813 | A | * | 7/1999 | Evans et al. | 455/422 |
| 6,239,736 | B1 | * | 5/2001 | McDonald et al. | 340/554 |

* cited by examiner

*Primary Examiner*—Van T Trieu

(57) ABSTRACT

An electromagnetic intrusion detection system which has a transmitter that produces a radio frequency output which is received by an antenna which receives the output and radiates an electromagnetic field into the surrounding space. This in turn responds to the presence of an object or an environmental condition causing absorption and/or reflection. A monitoring apparatus monitors power consumption and thus provides a signal output relating to the environmental condition and/or intrusion.

5 Claims, 3 Drawing Sheets

$V_{BATT.}$
VREG
INVERT & DRIVE
RF RX
RF XMITTER & MODEM
ΔRF TX
μC/μP
$V_{CC}$
$AD_0$
$F_1$
$AD_1$
$PWM_1$
$P_1$
$P_2$
$S_1$
$AD_2$
$AD_3$
$P_3$
0V
$F_2$
$PWM_2$

METHOD AND APPARATUS FOR ELECTRODYNAMIC INTRUSION DETECTION

This application is based on and claims priority of U.S. Provisional Ser. No. 60/168,782, filed Dec. 2, 1999.

SUMMARY OF THE INVENTION

The present invention serves to produce/generate and monitor electrodynamic interactions between earthed (i.e., electrically grounded) metallic/conductive structures and their ambient electromagnetic (EM) surroundings. The present invention utilizes a novel adaptive resonance-based electromagnetic signal generation and analysis technique, that can be practically utilized as a theft deterrent system for heavy equipment, or for intrusion detection in structures and on long baseline barrier (i.e., fence) applications. The novel and key component in all of these applications is the ability of the system to function with earthed structures (i.e., metal buildings or structures containing large conductive members, fences and tracked or bladed heavy equipment) and in a changing EM ambient.

Unlike other tamper/intrusion detection methods (i.e., ultrasound, vibration, microwave, infrared, laser etc.), the present invention uses the entire structure that is to be monitored as the active sensing element, thereby eliminating zone coverage limitations/problems/issues.

In a typical practical application such as for a "Heavy Equipment Theft Deterrent/Loss Prevention System", the present invention is capable of detecting unwanted intrusion or tampering on heavy equipment. It remotely alerts (via paging network or cellular link) the equipment owner or equipment supervisor when intrusion is detected. Optional practical features include engine fire detection (thermal sensing) and low vehicle battery alerts.

BACKGROUND OF THE INVENTION

The present invention utilizes a novel adaptive "EM Resonance" technique to provide for intrusion detection. This technique provides a far greater degree of performance and lower production costs, in comparison to prior art intrusion detection methods and apparatus.

With a view towards a practical application such as the protection of heavy equipment (i.e., bulldozer or excavator), a brief overview of the adaptive resonance technique will now be given. The metal frame and chassis of a piece of heavy equipment can be considered as a single electrically conductive (and usually magnetically permeable) mass having certain electromagnetic characteristics. These characteristics would normally be fairly easily definable and hence usable for intrusion detection via various electromagnetic means (i.e., if the equipment structure was electrically isolated from its surroundings). However, most such pieces of heavy equipment, including rubber-tired ones, usually have an implement or blade etc. in contact with the earth or ground when parked and at rest.

As a result, the equipment mass/structure is effectively electrically short-circuited to the earth and although the earth is not considered a very good conductor of electricity, it can range from fairly good (when very wet/or high ion content) to fairly poor (when very dry). This range of electrical conductivity is quite broad and presents a major stumbling block to using electromagnetic means for intrusion detection in such applications.

The reason for this is that the equipment mass essentially couples to, and becomes part and parcel of, what is called the radio frequency ground plane. This coupling can vary dramatically, not just due to equipment mass, size, or topology, but mainly due to ground conductivity and further, according to the frequency of any applied or incident electromagnetic energy.

In the novel method according to one embodiment of the present invention, a small amount of electromagnetic energy (RF) is emitted (radiated) into the so-called near-field space surrounding the equipment. Due to the nature of the coupling to the ground plane, this radiation pattern is essentially omni-directional and roughly in the shape of the horizontal outline of the equipment. The energy absorbed/reflected within this field space/zone is a function of the frequency of the EM radiation, its power and the EM susceptibility of the ground plane, as well as the presence of any nearby obstructions. Accordingly, this can vary greatly.

The amount of EM energy that is absorbed by everything (EM ambient) surrounding the emitter (antenna) is measured and continually monitored by the system. This will be at a minimum when everything is at EM resonance (we can do this because only at resonance, will half the power radiate into free space, and the other half be reflected).

Any changes in the near field conditions will affect the reflected energy, but these changes are usually only slowly time-variant or small in effect. Further, the intrusion of a fairly conductive body (such as a human) into the near-field (at ground level) will not in itself perceptibly affect reflected energy (i.e., due to varying absorption), however, contact with the equipment (or even EM coupling as through gloves) will dramatically affect reflected energy and hence, the systems resonance point.

The apparatus according to the present invention, continually adapts itself to the normal slowly time-varying EM resonance point (even due to rainfall etc.) and it does this many times per second. It is immune to false triggering caused by ambient changes and even to animals brushing against the equipment. However, tampering attempts involving the use of tools (i.e., hydraulic cylinder or implement detachment) will cause a sufficiently rapid and gross enough EM resonance shift to trigger the system.

Although generically speaking, the method and apparatus according to the present invention falls under the heading of RF proximity sensing or detection, there appears to be no prior art anticipating the use of adaptive resonance means.

Further, according to another embodiment of the present invention, there is shown the use of a two-way paging network (or cellular network) for the wireless notification of disturbances/intrusions/tampering, power line carrier based communications with fire/temperature sensors, a starter disabling attachment, and a visible dye/radioactive marker attachment.

Aside from the application towards heavy equipment, the present invention has application and promise for the following—boats (with large metallic sub-structures), grounded metal fencing, grounded metal buildings/structures, and even in ground insulated domestic wood-structured housing, as an alarm therefor (i.e., if the overall structure employs metal forced-air heat ducting or metal hot water piping).

DETAILED DESCRIPTION OF THE DRAWINGS

Figure 1:
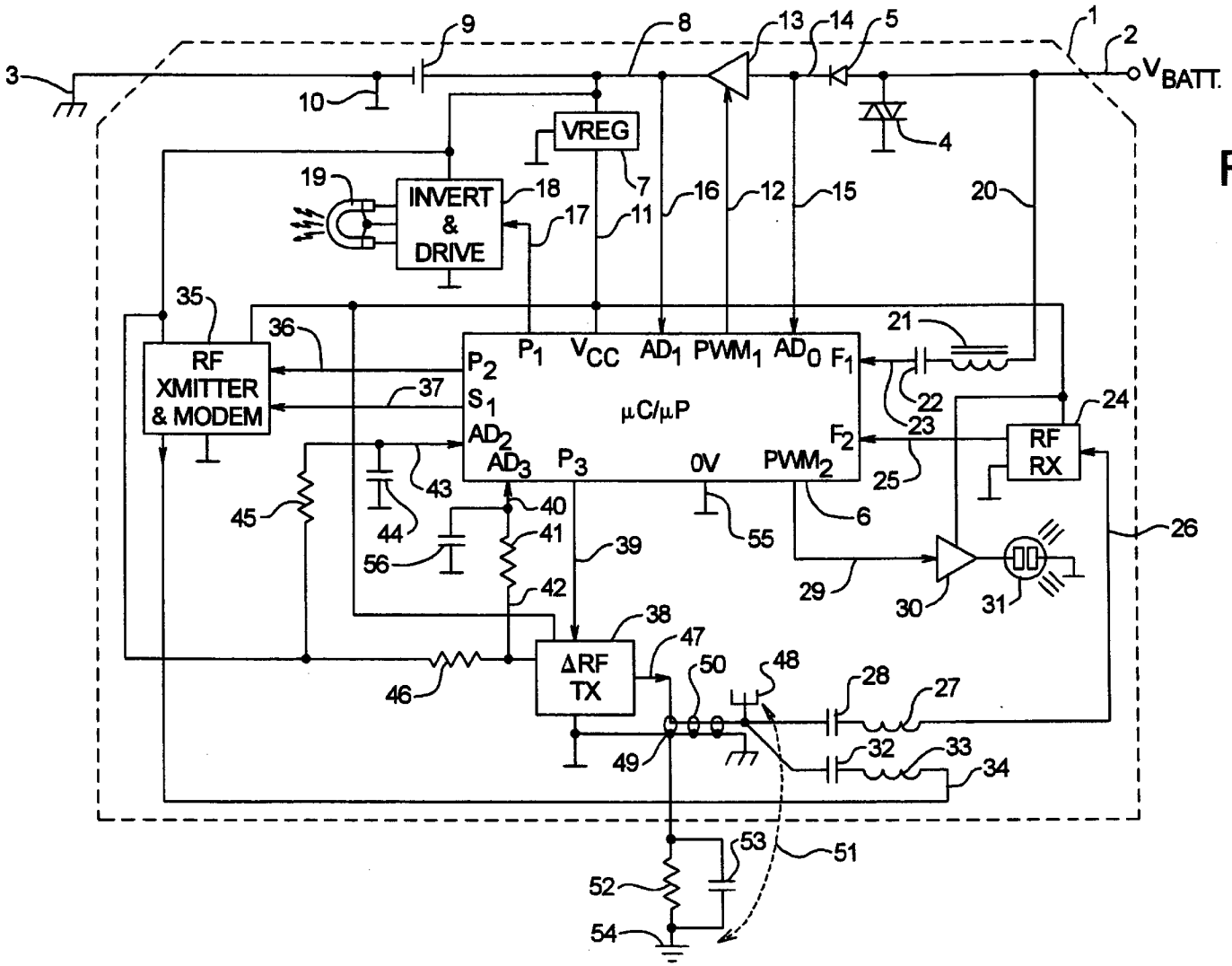
FIG. 1 shows schematically, a preferred embodiment of the method and apparatus according to the present invention, wherein the radiated EM energy is of fixed frequency and only changes in the ambient absorption of the EM radiation are monitored.

With reference now to FIG. 1, there is shown a preferred embodiment of the method and apparatus according to the present invention, wherein the radiated EM energy is of fixed frequency and only changes in the ambient absorption of the EM radiation are monitored. As shown in FIG. 1, the system is depicted as being contained within the dashed lines 1. External connections comprise two electrical connections, a chassis ground 3 and positive electrical supply 2. Electrical power is therefore supplied to the present invention from an external battery supply such as may be found on a host vehicle such as an earth moving apparatus or the like. Said chassis ground 3 therefore serves as the return path for said electrical power flow. A further external connection of an electromagnetic nature is also provided as indicated by electromagnetic wave propagation 51 and will be described in detail later. Said positive electrical supply 2 typically has potential of 12 or 24 volts and may deviate considerably below and above this value depending on various factors. Transient suppressor 4 is provided to quench or bypass high voltage transients that may appear due to inductive load dumping or battery boosting of said host vehicle. Further, diode 5 is provided for reverse polarity protection. Line 14 therefore always lies at a positive potential that is somewhat representative of the host vehicle battery voltage.

There is also shown a microcontroller or microprocessor 6, such as is well known in the art, and it has various digital and analog input and output capabilities, which are utilized by the present invention and will now be described. Said internal supply line 14 also provides a host battery potential signal to an analog input (ADO) of said microcontroller (uC) 6 via line 15. This allows uC 6 to perform an analog to digital conversion of said host battery signal at chosen intervals and thereby track and determine the condition of said host battery, or even the physical disconnection thereof (i.e., cutting of said power supply line 2 or battery terminal disconnection.) Said internal supply line 14 provides a positive electrical input to a power switch 13, which can be of a bipolar or field-effect transistor type, such as are well known in the art. Said power switch 13 is controlled via line 12 from a pulse-width modulated output (PWM1) from said uC 6. The output line 8 from said power switch 13 is connected to an internal backup battery 9 (nominally 12V@3000 mA/hr capacity), with line 10 therefrom providing the system internal ground. The positive terminal of said internal backup battery 9 is also connected via said power switch output line 8 and line 16, to a further analog input (AD1) of said uC 6. This allows uC 6 to perform an analog to digital conversion of said backup battery potential at chosen intervals and thereby track and determine the condition of said backup battery.

Accordingly, uC 6 can control said power switch 13 with a pulse-width modulated signal via line 12, in order to maintain a set level of potential (and charge) of said backup battery 9 and also to supply the requisite power (nominally 12 V) for the rest of the system. Also shown, is voltage regulator 7, which serves to regulate the supply potential and distribute said supply potential to various components and sub-blocks of the system via line 11. uC 6 is also powered from said line 11 and is grounded via 55. Shown further, is a high voltage inverter and drive circuit 18, which serves to raise the nominal unregulated 12 V system voltage to around 1000 V, provide capacitive storage (not shown), and a high voltage trigger pulse (not shown) in order to produce a periodic gas discharge within flash lamp 19, which is of the common xenon type. Said inverter and drive circuit 18 is under the control of a digital output (P1) from said uC 6 via line 17. In this manner, under firmware control, uC 6 can cause a high intensity luminous discharge from said lamp 19 (i.e., strobe) for the purpose of visibly attracting attention when necessary, or for producing visible feedback prompts.

Also shown, is a power switch 30, which serves to drive an acoustic transducer 31. Said power switch 30 is under the control of a pulse-width modulated output (PWM2) from said uC 6 via line 29. In this manner, uC 6 can produce a high intensity audible acoustic emission for the purpose of audibly attracting attention when necessary, or for producing audible feedback prompts. Further, the frequency, duration and intensity of the generated audible acoustic emission is under the control of uC 6 by virtue of its generated pulse-width modulated output, which is under firmware control.

The above described two subsystems serve to produce locally visible and audible emissions for warning and other purposes. The system further includes a radio-frequency transmitter and modem 35 (e.g., paging transmitter, cellular, VHF or UHF etc.), which the system can use for one-way transmittal of data to a remote location. The RF output of said RF transmitter and modem 35 is fed by line 34 through bandpass filter components 33 and 32 to the system antenna 48 (said antenna is shared by a number of system sub-blocks.) uC 6 controls said RF transmitter and modem 35 via line 36 from a digital output (P2). Further, uC 6 can present formatted data from its serial output (S1) to said RF transmitter and modem 35 via line 37.

Accordingly, the system can thereby remotely (via RF) report intrusions (will be described in detail later), host battery disconnection, battery status (both host and internal backup), system status and malfunctions and various other optional parameters.

As an example thereof, one may have thermal/fire sensors deployed on said host vehicle (i.e., near the engine) and these can be of the type that utilize relatively low frequency RF carriers over the existing host vehicle power wiring. Although not shown such a sensor is powered from the host vehicle power wiring and when triggered (i.e., high temperature) such said sensor will superimpose said RF carrier at a certain frequency onto said power wiring (this approach greatly minimizes sensor installation requirements.)

In accordance with such, there is shown a method for receiving such an RF carrier from said sensor. Line 20 is seen to be connected to the host vehicle positive electrical supply 2. Bandpass filter components 21 and 22 serve to localize spectral sensitivity to the RF frequency region of interest (not shown are possible requisite amplifier stages.)

The output thereof is fed via line 23 to a frequency detector input (F1) on uC 6. The appearance on said host vehicle's power wiring of an appropriate frequency for a sufficient duration of time (i.e., from a temperature sensor) can thereby be detected by said uC 6 and classified via firmware in order to produce an appropriate response or action by the system.

Further shown in FIG. 1, is a remote control radio-frequency receiver 24 (e.g., 300 or 308 MHz), which the system can use for the reception of RF signals from a remote control transmitter (the remote control transmitter is not shown.) This is utilized for short range (i.e., local area to the host vehicle, <200 m) for arming and disarming the system etc. Said RF receiver 24 is fed via line 26 from bandpass filter components 27 and 28 from shared system antenna 48. The demodulated output from RF receiver 24 is presented to a frequency detector input (F2) on uC 6 via line 25.

Finally, for the fundamental purpose of detecting intrusions and disturbances electromagnetically, there is shown an RF transmitter 38, whose output 47 is coupled via a transmission line or coax cable comprised of conductor 50 and shield/ground plane segment 49, to said shared system antenna 48 and to a chassis ground point local thereto. Said RF transmitter 38 is of a fixed frequency type in this preferred embodiment, said frequency chosen to fit within the spectral resonance range for a given size/surface area of possible host vehicles. Said RF transmitter 38 is under the control of uC 6 from digital output (P3) via line 39 and typically said RF transmitter 38 is turned on at regular intervals and for a specific duration (i.e., pulsed), but it may also be energized at pseudo-random intervals.

When so energized, said RF transmitter 38 radiates an electromagnetic (RF) field from shared system antenna 48 and the near field (primarily near field and not the far field) absorption and reflection of electromagnetic energy by ambient surroundings and objects will determine the net effective radiated electromagnetic energy, and consequently, the amount of power drawn from the system power supply by said RF transmitter 38. Further, there are shown external coupling components 52 (resistive) and 53 (capacitive), which serve to represent the electromagnetic coupling parameters associated with a portion or portions of said host vehicle being in contact with the earth 54. There will be continuous variability in said external coupling parameters (due to changes in the earth's conductivity etc.), and these changes must be tracked and gross disturbances and intrusions in the near field must be isolated.

To accomplish this, uC 6 monitors the power consumption of RF transmitter 38, which will directly vary according to the previously described variations in the near field absorption and reflection characteristics (both continuous and transient.) Accordingly, an analog input (AD2) on uC 6 is provided with a signal on line 43 from resistor 45, which is in series with a direct connection to the unregulated positive power supply bus of the system. Capacitor 44 serves to provide a small degree of filtering or smoothing. Said RF transmitter 38 is provided its main RF transmit power from the unregulated positive power supply bus through series resistor 46. Line 42 connects this power input to series resistor 41, which via line 40, presents a signal to an analog input (AD3) on uC 6. Capacitor 56 serves to provide filtering. This last signal will vary in direct proportion to the power consumption of said RF transmitter 38. Via the monitoring of the differences between the two separate analog signals so acquired (i.e., when RF transmitter 38 is energized), uC 6 and its resident firmware can determine and track changes in the near field electromagnetic interactions, thereby detecting sudden gross disturbances and shifts such as are indicative of an intrusion and not of any natural drift.

Figure 2:
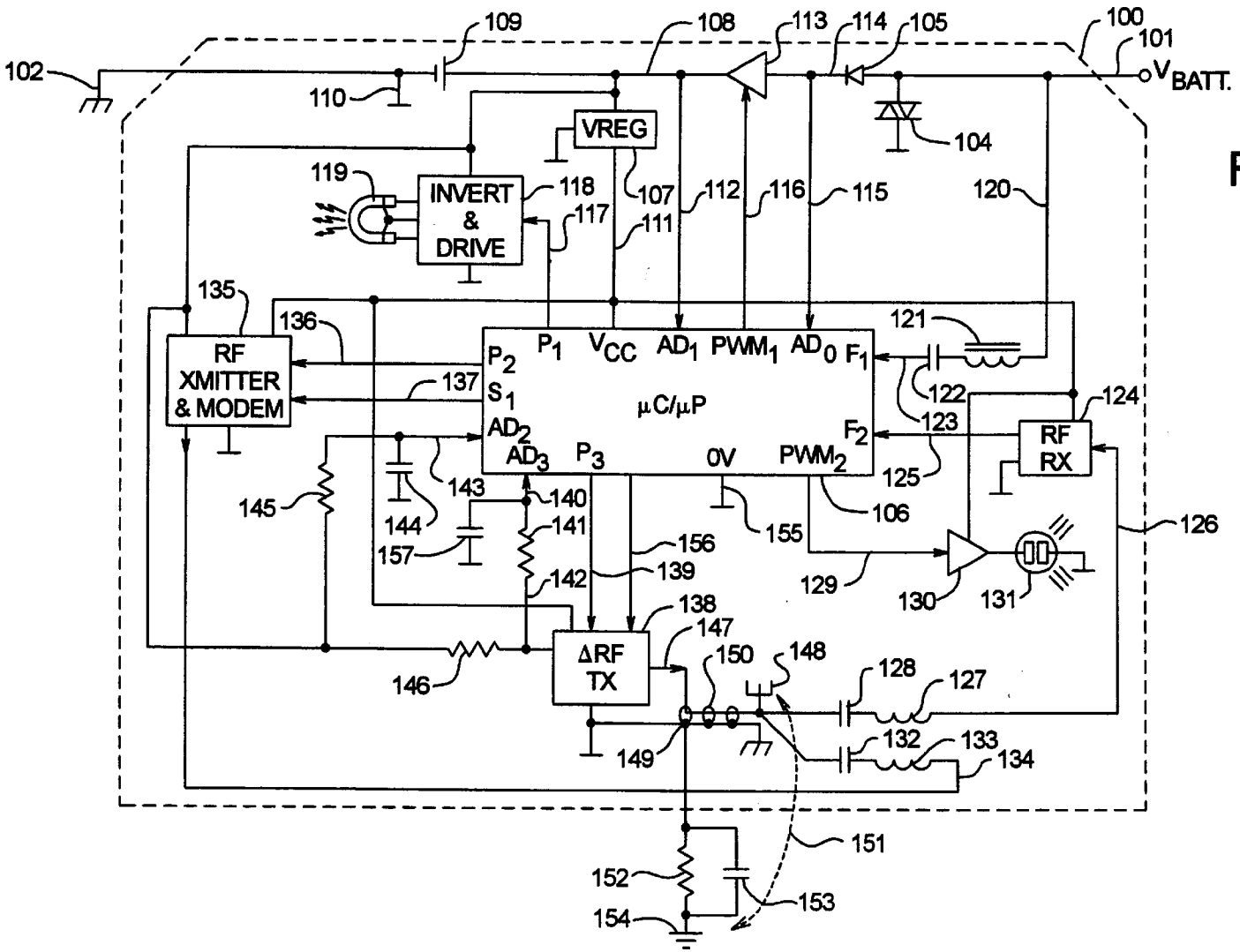
FIG. 2 shows schematically, a more preferred embodiment of the method and apparatus according to the present invention, wherein the radiated EM energy is of variable frequency and can thereby be continually tuned to track the resonant frequency of the overall system, which occurs at the point of maximum ambient absorption of the EM radiation.

With specific reference now to FIG. 2, there is shown a more preferred embodiment of the method and apparatus according to the present invention, wherein the radiated EM energy is of variable frequency. This serves to maximize near field EM interaction through tuning said EM frequency to the resonance frequency of the overall system. Hence, changes in the ambient absorption of the EM radiation are then monitored by tracking said variable frequency (i.e., resonance frequency.)

As shown in FIG. 2, the system is depicted as being contained within the dashed lines 100. External connections comprise two electrical connections, a chassis ground 102 and positive electrical supply 101. Electrical power is therefore supplied to the present invention from an external battery supply such as may be found on a host vehicle such as an earth moving apparatus or the like. Said chassis ground 102 therefore serves as the return path for said electrical power flow. A further external connection of an electromagnetic nature is also provided as indicated by electromagnetic wave propagation 151 and will be described in detail later. Said positive electrical supply 101 typically has potential of 12 or 24 volts and may deviate considerably below and above this value depending on various factors. Transient suppressor 104 is provided to quench or bypass high voltage transients that may appear due to inductive load dumping or battery boosting of said host vehicle. Further, diode 105 is provided for reverse polarity protection. Line 114 therefore always lies at a positive potential that is somewhat representative of the host vehicle battery voltage.

There is also shown a microcontroller or microprocessor 106, such as is well known in the art, and it has various digital and analog input and output capabilities, which are utilized by the present invention and will now be described. Said internal supply line 114 also provides a host battery potential signal to an analog input (ADO) of said microcontroller (uC) 106 via line 115. This allows uC 106 to perform an analog to digital conversion of said host battery signal at chosen intervals and thereby track and determine the condition of said host battery, or even the physical disconnection thereof (i.e., cutting of said power supply line 101 or battery terminal disconnection.) Said internal supply line 114 provides a positive electrical input to a power switch 113, which can be of a bipolar or field-effect transistor type, such as are well known in the art. Said power switch 113 is controlled via line 116 from a pulse-width modulated output (PWM1) from said uC 106. The output line 108 from said power switch 113 is connected to an internal backup battery 109 (nominally 12 V@3000 mA/hr capacity), with line 110 therefrom providing the system internal ground. The positive terminal of said internal backup battery 109 is also connected via said power switch output line 108 and line 112, to a further analog input (AD1) of said uC 106. This allows uC 106 to perform an analog to digital conversion of said backup battery potential at chosen intervals and thereby track and determine the condition of said backup battery.

Accordingly, uC 106 can control said power switch 113 with a pulse-width modulated signal via line 116, in order to maintain a set level of potential (and charge) of said backup battery 109 and also to supply the requisite power (nominally 12 V) for the rest of the system. Also shown, is voltage regulator 107, which serves to regulate the supply potential and distribute said supply potential to various components and sub-blocks of the system via line 111. uC 106 is also powered from said line 111 and is grounded via 155.

Shown further, is a high voltage inverter and drive circuit 118, which serves to raise the nominal unregulated 12 V system voltage to around 1000 V, provide capacitive storage (not shown), and a high voltage trigger pulse (not shown) in order to produce a periodic gas discharge within flash lamp 119, which is of the common xenon type. Said inverter and drive circuit 118 is under the control of a digital output (P1) from said uC 106 via line 117. In this manner, under firmware control, uC 106 can cause a high intensity luminous discharge from said lamp 119 (i.e., strobe) for the purpose of visibly attracting attention when necessary, or for producing visible feedback prompts.

Also shown, is a power switch 130, which serves to drive an acoustic transducer 131. Said power switch 130 is under the control of a pulse-width modulated output (PWM2) from said uC 106 via line 129. In this manner, uC 106 can produce a high intensity audible acoustic emission for the purpose of audibly attracting attention when necessary, or for producing audible feedback prompts. Further, the frequency, duration and intensity of the generated audible acoustic emission is under the control of uC 106 by virtue of its generated pulse-width modulated output, which is under firmware control.

The above described two subsystems serve to produce locally visible and audible emissions for warning and other purposes. The system further includes a radio-frequency transmitter and modem 135 (e.g., paging transmitter, cellular, VHF or UHF etc.), which the system can use for one-way transmittal of data to a remote location. The RF output of said RF transmitter and modem 135 is fed by line 134 through bandpass filter components 133 and 132 to the system antenna 148 (said antenna is shared by a number of system sub-blocks.) uC 106 controls said RF transmitter and modem 135 via line 136 from a digital output (P2). Further, uC 106 can present formatted data from its serial output (S1) to said RF transmitter and modem 135 via line 137.

Accordingly, the system can thereby remotely (via RF) report intrusions (will be described in detail later), host battery disconnection, battery status (both host and internal backup), system status and malfunctions and various other optional parameters.

As an example thereof, one may have thermal/fire sensors deployed on said host vehicle (i.e., near the engine) and these can be of the type that utilize relatively low frequency RF carriers over the existing host vehicle power wiring. Although not shown such a sensor is powered from the host vehicle power wiring and when triggered (i.e., high temperature) such said sensor will superimpose said RF carrier at a certain frequency onto said power wiring (this approach greatly minimizes sensor installation requirements.)

In accordance with such, there is shown a method for receiving such an RF carrier from said sensor. Line 120 is seen to be connected to the host vehicle positive electrical supply 101. Bandpass filter components 121 and 122 serve to localize spectral sensitivity to the RF frequency region of interest (not shown are possible requisite amplifier stages.) The output thereof is fed via line 123 to a frequency detector input (F1) on uC 106. The appearance on said host vehicle's power wiring of an appropriate frequency for a sufficient duration of time (i.e., from a temperature sensor) can thereby be detected by said uC 106 and classified via firmware in order to produce an appropriate response or action by the system.

Further shown in FIG. 2, is a remote control radio-frequency receiver 124 (e.g., 300 or 308 MHz), which the system can use for the reception of RF signals from a remote control transmitter (the remote control transmitter is not shown.) This is utilized for short range (i.e., local area to the host vehicle, <200 m) for arming and disarming the system etc. Said RF receiver 124 is fed via line 126 from bandpass filter components 127 and 128 from shared system antenna 148. The demodulated output from RF receiver 124 is presented to a frequency detector input (F2) on uC 106 via line 125.

Finally, for the fundamental purpose of detecting intrusions and disturbances electromagnetically, there is shown an RF transmitter 138, whose output 147 is coupled via a transmission line or coax cable comprised of conductor 150 and shield/ground plane segment 149, to said shared system antenna 148 and to a chassis ground point local thereto. Said RF transmitter 138 is of a variable frequency type in this more preferred embodiment and its transmission frequency is controlled by uC 106 via serial data output (S1) over line 156. Said RF transmitter 138 is under the control of uC 106 from digital output (P3) via line 139 and typically said RF transmitter 138 is turned on at regular intervals and for a specific duration (i.e., pulsed), but it may also be energized at pseudo-random intervals.

When so energized, said RF transmitter 138 radiates an electromagnetic (RF) field from shared system antenna 148 and the near field (primarily near field and not the far field) absorption and reflection of electromagnetic energy by ambient surroundings and objects will determine the net effective radiated electromagnetic energy, and consequently, the amount of power drawn from the system power supply by said RF transmitter 138. Further, there are shown external coupling components 152 (resistive) and 153 (capacitive), which serve to represent the electromagnetic coupling parameters associated with a portion or portions of said host vehicle being in contact with the earth 154. There will be continuous variability in said external coupling parameters (due to changes in the earth's conductivity etc.), and these changes must be tracked and gross disturbances and intrusions in the near field must be isolated.

To accomplish this, uC 106 monitors the power consumption of RF transmitter 138, which will directly vary according to the previously described variations in the near field absorption and reflection characteristics (both continuous and transient.) Accordingly, an analog input (AD2) on uC 106 is provided with a signal on line 143 from resistor 145, which is in series with a direct connection to the unregulated positive power supply bus of the system. Capacitor 144 serves to provide a small degree of filtering or smoothing. Said RF transmitter 138 is provided its main RF transmit power from the unregulated positive power supply bus through series resistor 146. Line 142 also connects this power input to series resistor 141, which via line 140, presents a signal to an analog input (AD3) on uC 106. Capacitor 157 serves to provide filtering. This last signal will vary in direct proportion to the power consumption of said RF transmitter 138. Via the monitoring of the differences between the two separate analog signals so acquired (i.e., when RF transmitter 138 is energized), uC 106 and its resident firmware can determine and track changes in the near field electromagnetic interactions, continuously adjust the frequency of RF transmitter 138 to that of maximum near field absorption (occurs at resonance) and thereby more effectively detect sudden gross disturbances and shifts such as are indicative of an intrusion and not of any natural drift.

Figure 3:
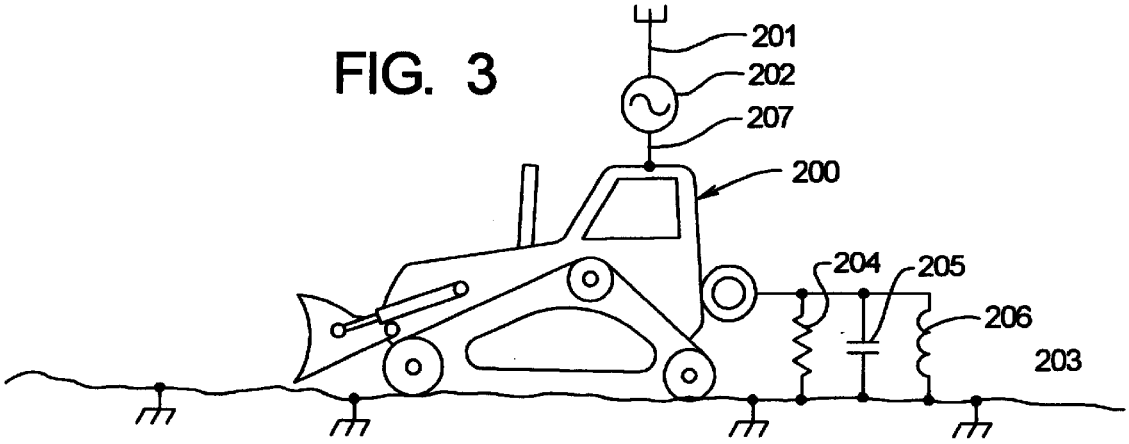
FIG. 3 shows partially pictorially and partially schematically, the method and apparatus according to the present invention when applied to a metal-tracked heavy equipment structure.

With reference now to FIG. 3, there is shown a host vehicle 200, such as of the tracked earth moving type. The system antenna is depicted as 201 and its chassis ground plane connection is shown as 207. The electromagnetic emission portion of the present invention (i.e., intrusion detection RF transmitter) is shown as 202. Normally (if the host vehicle was isolated from the earth), the near field electromagnetic interactions would be stable and interaction with the earth 203 would include only the effects of capacitive coupling 205 and inductive coupling 206. However, because a portion of said host vehicle may actually be in electrical contact with said earth 203, as depicted by resistive coupling 204, said three coupling parameters become extremely complex and for a given frequency, will exhibit long term electromagnetic variations and changes.

Figure 4:
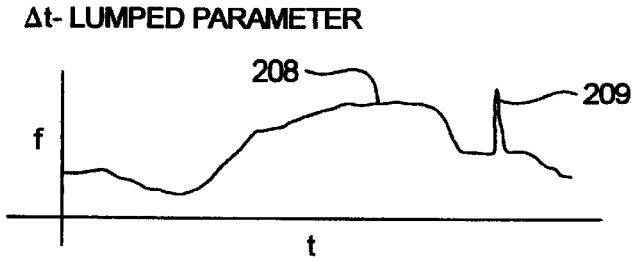
FIG. 4 shows graphically, the change in the resonant frequency versus time, of the overall system shown in FIG. 3, due to both natural ambient variations and an actual intrusion/tampering event.

With reference to FIG. 4, there is shown a graph depicting typical long term electromagnetic variations and changes as experienced by the system according to the present invention. Said graph of FIG. 4 shows the time (t) along its abscissa and the system resonant frequency (f) along its ordinate. The resonant frequency can be considered to be a function of the lumped coupling parameters as previously described (hence the title delta t-lumped parameter) and their changes over time. The resonant frequency 208 can be seen to vary and change more or less smoothly over time, whereas 209 shows a gross and marked (and sudden) disturbance indicative of an intrusion into the near field.

Therefore, I claim:

1. An electromagnetic intrusion detection apparatus comprising:

a) a transmitter which produces a radio frequency output;

b) a radio frequency antenna which receives the output from the transmitter and radiates an electromagnetic field into surrounding free space, and which responds to the presence of an object and/or environmental conditions which by absorption and/or reflection would modify the electromagnetic field and thus modify the power consumption of the transmitter;

c) a monitoring apparatus which monitors power consumption of the transmitter and identifies modifications in said power consumption, said monitoring apparatus being capable of identifying expected modifications that occur in expected surrounding environmental conditions and differentiating such expected modifications in power consumption in expected environmental conditions from modifications in power consumption characteristic of intrusions and/or expected surrounding environmental conditions;

d) said monitoring and analyzing apparatus providing a signal output to indicate an unexpected environmental condition and/or intrusion.

2. The apparatus as recited in claim 1, wherein said monitoring apparatus monitors rate of change of said power consumption, amplitude of power consumption and/or a combination of rate of change and magnitude of power consumption to identify modifications outside of said expected modifications.

3. The apparatus as recited in claim 1, wherein:

a) said transmitter produces said output as pulses, said pulses having either a constant frequency or varying frequencies;

b) an intrusion warning device or devices selected from a group comprising an audible output device, a visual output device, an electromagnetic output device, an electrical output device, and combinations thereof;

c) said transmitter having its output being connected to a ground connection, with power dissipated to said ground connection varying at least partially due to environmental conditions, and said monitoring apparatus receiving input of such variations related to environmental conditions at said ground connection;

d) said monitoring apparatus comprising a microcontroller;

e) said apparatus comprising an optional radio frequency receiver for arming and disarming said apparatus, and;

f) said detection apparatus further comprising a second ground connection to an electromagnetically permeable metallic member associated with which said apparatus is associated.

4. A method of electromagnetic detection of intrusion comprising:

a) operating a transmitter to produce a radio frequency output to an antenna to cause said antenna to radiate an electromagnetic field into surrounding free space, and to respond to presence of an object and/or environmental conditions which by absorption and/or reflection would modify the electromagnetic field and thus modify the power consumption of the transmitter;

b) monitoring power consumption of the transmitter and identifying modifications in said power consumption;

c) identifying expected modifications that occur in expected surrounding environmental conditions;

d) differentiating such expected modifications in power consumption in expected environmental conditions from modifications in power consumption characteristic of unexpected intrusions into said electromagnetic field and/or modifications in the surrounding environmental conditions not characteristic of the expected surrounding environmental conditions;

e) providing a signal output to indicate an unwanted intrusion or an unexpected occurrence or change in said surrounding environmental conditions.

5. The method as recited in claim 4 wherein there is a metal structure, which is selected from a group comprising construction equipment, other mobile equipment, metal buildings, metal components of buildings or other structures and/or metal fences, and said method is accomplished in association with said metal structure.

* * * * *